US008003590B2

(12) United States Patent
Brooker

(10) Patent No.: US 8,003,590 B2
(45) **Date of Patent: *Aug. 23, 2011**

(54) DETERGENT COMPOSITION COMPRISING REACTIVE DYE

(75) Inventor: Alan Thomas Brooker, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/413,705

(22) Filed: Apr. 30, 2009

(65) Prior Publication Data

US 2009/0253607 A1 Oct. 8, 2009

(30) Foreign Application Priority Data

Apr. 2, 2008 (EP) ..... 08006707

(51) Int. Cl.
*C11D 17/00* (2006.01)

(52) U.S. Cl. ..... 510/276; 510/343; 510/395; 510/419

(58) Field of Classification Search ..... 510/276, 510/343, 395, 419

See application file for complete search history.

(56) References Cited

U.S. PATENT DOCUMENTS

| | | | | | |
|---|---|---|---|---|---|
| 4,661,280 | A * | 4/1987 | Ouhadi et al. | ..... | 510/338 |
| 5,043,091 | A * | 8/1991 | Joshi et al. | ..... | 510/294 |
| 5,259,994 | A * | 11/1993 | Welch et al. | ..... | 510/348 |
| 5,338,476 | A * | 8/1994 | Pancheri et al. | ..... | 510/352 |
| 5,770,552 | A * | 6/1998 | Bruhnke | ..... | 510/343 |
| 5,872,093 | A * | 2/1999 | Convents et al. | ..... | 510/475 |
| 5,912,221 | A * | 6/1999 | Van Leeuwen et al. | ..... | 510/360 |
| 5,932,708 | A * | 8/1999 | Phillips et al. | ..... | 534/603 |
| 6,126,700 | A * | 10/2000 | Bao-Kun et al. | ..... | 8/549 |
| 6,486,112 | B1 * | 11/2002 | Bettiol et al. | ..... | 510/320 |
| 6,583,096 | B1 * | 6/2003 | Kott et al. | ..... | 510/357 |
| 7,540,883 | B2 * | 6/2009 | Lai et al. | ..... | 8/641 |
| 2009/0253607 | A1 * | 10/2009 | Brooker | ..... | 510/320 |

FOREIGN PATENT DOCUMENTS

| | | | |
|---|---|---|---|
| WO | WO 2006/027086 | A | 3/2006 |
| WO | WO 2006/055787 | A | 5/2006 |

OTHER PUBLICATIONS

PCT International Search Report Dated Jun. 25, 2009—5 pgs.

* cited by examiner

*Primary Examiner* — Milton I Cano
*Assistant Examiner* — M. Reza Asdjodi
(74) *Attorney, Agent, or Firm* — Julie A. McConihay; Leonard W. Lewis; Steven W. Miller

(57) ABSTRACT

The present invention relates to a solid laundry detergent composition comprising a detersive surfactant and a reactive dye, wherein upon contact with water the composition has an equilibrium pH of 10.5 or greater at a concentration of 4 g/l in de-ionized water and at a temperature of 20° C.

17 Claims, 1 Drawing Sheet

DETERGENT COMPOSITION COMPRISING REACTIVE DYE

This application has claimed priority from EPO 08006707.7.

FIELD OF THE INVENTION

The present invention relates to a laundry detergent composition that is capable of dyeing fabric and cleaning fabric during a laundering process. The laundry detergent composition is in solid form and comprises a detersive surfactant and a reactive dye. The laundry detergent composition has a pH of 10.5 or greater at a concentration of 4 g/l in de-ionized water and at a temperature of 20° C.

BACKGROUND OF THE INVENTION

Laundry detergent manufacturers have attempted to meet the consumer need to rejuvenate coloured fabrics and provide good fabric-cleaning performance during the laundering process. Current fabric treatment compositions that comprise fabric-substantive dyes do not adequately clean the fabric during the laundering process, and the consumer still needs to use additional conventional laundry detergent compositions (i.e. that do not comprise fabric-substantive dyes) in order to adequately clean the fabric. However, this combination is costly and not efficient as two separate laundering processes need to be undertaken. Furthermore, previous attempts by the detergent manufacturers to provide a detergent composition that provides a good colour-rejuvenation profile have focused on dyes that are used to dye fabrics during textile mill processes, and to incorporate these dyes into laundry detergent compositions. However, these dyes are not as fabric substantive during the laundering process when relatively low temperatures (from 5° C. to 60° C.) typical of domestic laundering processes are used compared to the textile mill process when relatively higher temperatures (90° C. to 95° C.) typical of textile mill processing conditions are used. Simply incorporating these dyes into conventional laundry detergent compositions leads to inefficient colour rejuvenation profile.

Furthermore, over multiple wash cycles, the colour of fabrics laundered with conventional laundry detergent compositions deteriorates to an undesirable degree. There continues to be a need to provide a laundry detergent composition that provides good colour care, colour rejuvenation and a good cleaning performance.

The Inventors have found that the colour rejuvenation profile of solid laundry detergent composition is improved by combining a reactive dye and a detersive surfactant in a composition that has a relatively higher pH, wherein upon contact with water the composition has an equilibrium pH of 10.5 or greater at a concentration of 4 g/l in de-ionized water and at a temperature of 20° C.

Without wishing to be bound by theory, it is believed that the high pH improves the strength of the dye-fabric interaction, improves the fabric-substantivity of reactive dye and improves the colour rejuvenation profile of the solid laundry detergent composition. The inventors have found that such laundry detergent compositions provide both a good fabric-cleaning profile and a good colour-rejuvenation profile.

SUMMARY OF THE INVENTION

In accordance with one embodiment, a solid laundry detergent composition is provided. The solid laundry detergent composition comprising a detersive surfactant and a reactive azo dye, wherein upon contact with water the composition has an equilibrium pH of 10.5 or greater at a concentration of 4 g/1 in de-ionized water and at a temperature of 20° C.

DETAILED DESCRIPTION OF THE INVENTION

Figure 1:
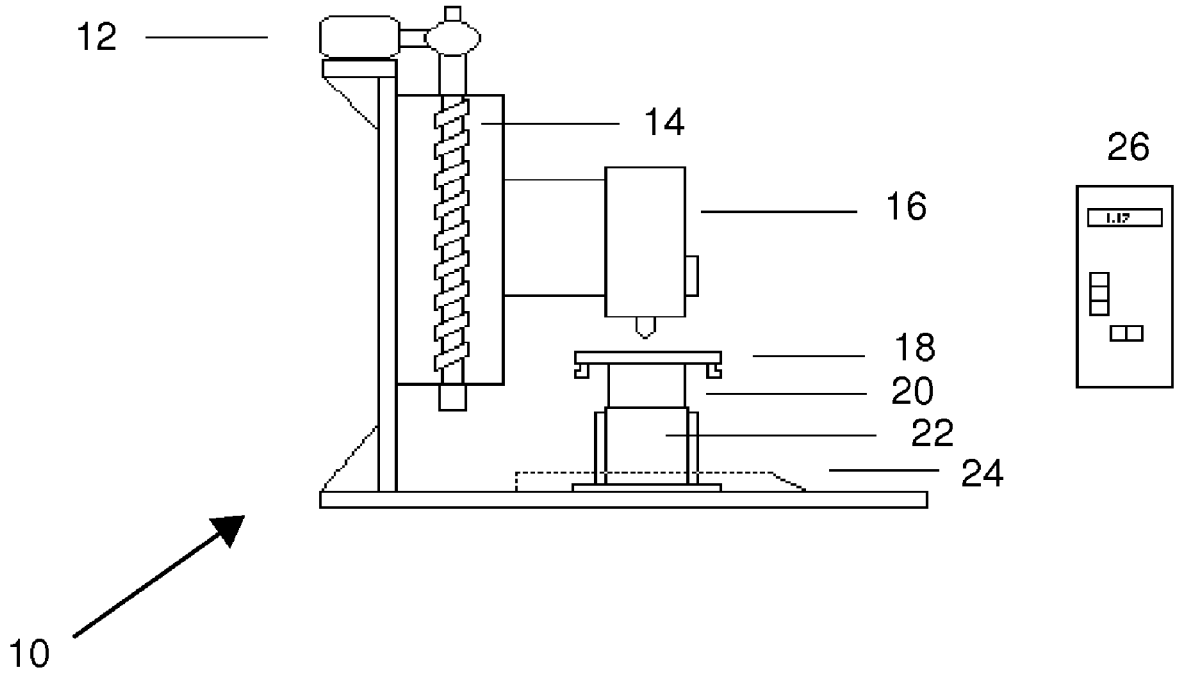
FIG. 1 illustrates a front view of a cake formation apparatus in accordance with one embodiment of the invention.

Solid Laundry Detergent Composition.

The solid laundry detergent composition comprises a detersive surfactant and a reactive dye. The detersive surfactant and reactive dye is discussed in more detail below.

Upon contact with water the composition has an equilibrium pH of 10.5 or greater at a concentration of 4 g/l in de-ionized water and at a temperature of 20° C. The pH profile of the composition is discussed in more detail below.

Preferably, the composition comprises an alkalinity source. The alkalinity source is discussed in more detail below.

Preferably, the composition comprises less than 5 wt %, or less than 4 wt %, or less than 3 wt %, or less than 2 wt %, or less than 1 wt % anionic detersive surfactant. Preferably, the composition is essentially free of anionic detersive surfactant. By "essentially free of" it is typically meant "no deliberately added". Reducing the level of, and even removing, the anionic detersive surfactant improves the colour-rejuvenation profile of the composition.

Preferably, the composition comprises less than 5 wt %, or less than 4 wt %, or less than 3 wt %, or less than 2 wt %, or less than 1 wt % sodium sulphate. Preferably, the composition is essentially free of sodium sulphate. By "essentially free of" it is typically meant "no deliberately added". Reducing the level of, and even removing, sodium sulphate chemically compacts the composition; and thus improving its transport efficiency, improving its shelf-storage efficiency, and further improving its environmental profile.

Preferably, the composition comprises less than 5 wt %, or less than 4 wt %, or less than 3 wt %, or less than 2 wt %, or less than 1 wt % bleach. Preferably, the composition is essentially free of bleach. By "essentially free of" it is typically meant "no deliberately added". Reducing, and even removing, bleach improves the colour rejuvenation profile of the composition.

Preferably, the composition comprises less than 10 wt %, or less than 5 wt %, or less than 4 wt %, or less than 3 wt %, or less than 2 wt %, or less than 1 wt % phosphate builder. Preferably, the composition is essentially free of phosphate builder. By "essentially free of" it is typically meant "no deliberately added". Reducing, and even removing, phosphate builder further improves the environmental profile of the composition.

Preferably, the composition comprises less than 10 wt %, or less than 5 wt %, or less than 4 wt %, or less than 3 wt %, or less than 2 wt %, or less than 1 wt % zeolite builder. Preferably, the composition is essentially free of zeolite builder. By "essentially free of" it is typically meant "no deliberately added". Reducing, and even removing, zeolite builder from the composition improves its dissolution profile.

Preferably, the composition comprises less than 10 wt %, or less than 5 wt %, or less than 4 wt %, or less than 3 wt %, or less than 2 wt %, or less than 1 wt % sodium silicate. Preferably, the composition is essentially free of sodium silicate. By "essentially free of" it is typically meant "no deliberately added". Reducing, and even removing, sodium silicate from the composition improves its dissolution profile.

Preferably, the composition comprises an enzyme system. The enzyme system is described in more detail below.

Detersive Surfactant.

The composition comprises a detersive surfactant. The detersive surfactant typically comprises an anionic detersive surfactant, a cationic detersive surfactant, a non-ionic detersive surfactant, a zwitterionic surfactant, or a mixture thereof. However, as discussed in more detail above, preferably the composition comprises a low level of, or is even essentially free of, anionic detersive surfactant. Preferably, the composition comprises a non-ionic detersive surfactant. This is especially preferred when the composition comprises low levels of, or is essentially free of, anionic detersive surfactant. Preferably, the non-ionic detersive surfactant comprises a $C_8$-$C_{24}$ alkyl alkoxylated alcohol having an average degree of alkoxylation of from 1 to 20, preferably a $C_{10}$-$C_{18}$ alkyl alkoxylated alcohol having an average degree of alkoxylation of from 1 to 10, or even a $C_{12}$-$C_{18}$ alkyl alkoxylated alcohol having an average degree of alkoxylation of from 1 to 7. Preferably, the non-ionic detersive surfactant is an ethoxylated alcohol. Preferably, the non-ionic surfactant comprises an alkyl polyglucoside. The non-ionic detersive surfactant may even be a predominantly $C_{16}$ alkyl ethoxylated alcohol having an average degree of ethoxylation of from 3 to 7.

Preferably, the non-ionic detersive surfactant is in particulate form, and wherein the particle has a cake strength of from 0 kg to 1.5 kg. The method to determine cake strength is described in more detail below.

Method to Determine the Cake Strength

The cake strength is typically determined by the following method:

Apparatus

Cake Former

The cake formation apparatus is designed to produce a cylindrical cake of 6.35 cm in diameter and 5.75 cm in height.

Referring to FIG. 1, in one embodiment, a cake formation apparatus may be provided. The cake formation apparatus 10 may comprise a motor 12, a screw 14, a gauge 16, a lid 18, a cake 20, a cylinder 22, a tray 24, and a digital force gauge 26.

CYLINDER Solid perspex, with polished surface.
- Diameter 6.35 cm
- Length 15.90 cm
- Base plate on end, diameter 11.40 cm, depth 0.65 cm
- 0.65 cm hole through the cylinder, with its centre 9.2 cm from the end opposite the base plate SLEEVE Hollow perspex, with polished inner surface
- Inner diameter 6.35 cm
- Wall thickness 1.50 cm
- Length 15.25 cm LID Perspex disc
- Diameter 11.5 cm
- Thickness 0.65 cm LOCKING PIN Stainless steel
- Diameter 0.6 cm
- Length 10 cm WEIGHTS 5 Kg to fit size of lid
- 10 kg, to fit size of lid Force Recorder FORCE GAUGE Either manual or electronic: battery/mains operated
- Max capacity 25 kg
- Graduations 0.01 kg MOTORISED Solid stand STAND Force gauge mounted on a block which moves in a vertical direction on a screw, driven by a reversible motor
- Rate of gauge descent=54 cm/min POWDER TRAY For collection of powder from broken cake STEEL RULE For smoothing top of cake Equipment Set-Up

SEE ATTACHED DRAWING.

Test Conditions

Conditioning: powder samples should be stored at 35° C. for 24 hrs before testing. Test equipment should also be at 35° C.

Procedure

Step by Step Procedure

1> Place cake formation cylinder on a flat surface
2> Place the locking pin in the hole.
3> Slip on the cake formation sleeve and check that it moves freely
4> Pour in representative test material sample until the material overflows the cylinder sides
5> Level off granules with one smooth action using a steel rule or equivalent straight edge.
6> Place top plate on cylinder and centre by eye.
7> Place weight on top of assembly
8> Carefully, gently remove the restraining rod and start timer
9> Whilst cake is being formed move force meter to top position and zero it.
10> After two minutes, remove weight
11> Slide down cylinder so cake is completely exposed (leaving top plate remaining).
12> Gently place cake formation assembly under force meter
13> Centre assembly under force gauge by eye.
14> Start force meter apparatus so that it descends and breaks cake.
15> Read the maximum force (in Kgs) required to break the cake from the force meter dial.
16> Repeat least three times for each material and average the forces, this average is the mean cake strength for the material tested.

Reactive Dye.

The composition comprises a fabric-substantive dye, preferably a reactive dye. Preferably, the dye is a reactive azo dye. Preferably, the composition comprises a black and/or blue reactive dye, although other reactive dyes such as red, orange and/or yellow reactive azo dyes may also be present.

The reactive dye preferably has the structural formula:

(I)

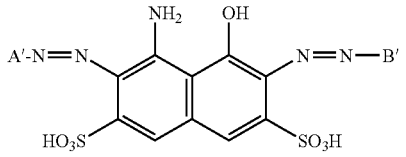

wherein A' and B' are each independent selected from an aromatic group which is unsubstituted or substituted by halogen, $C_1$-$C_4$ alkyl, $C_1$-$C_4$ alkoxyl, sulphonyl, or amino groups. Preferably, the reactive dye has the structural formula:

(II)

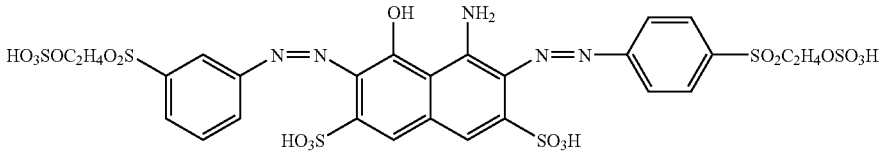

Suitable reactive dyes are described in more detail in U.S. Pat. No. 6,126,700.

Typically, the reactive dye comprises an anionic moiety, such as a sulphonyl moiety bound to the substituted naphthalene. However, for convenience, the above formulae show the reactive dye in their free acid form. Furthermore, the reactive dye is typically in the form of a salt, especially an alkali metal salt, such as sodium salt or potassium salt, or the salt can be in the form of an ammonium salt.

The reactive dye preferably comprises: (a) a black reactive dye having the above formula II; and (b) at least one other black or blue reactive dye having the above formula I, and preferably (c) at least one other red, orange and/or yellow reactive azo dye. The above described reactive dye that comprises components (a), (b) and (c) has an excellent dye build-up profile on the fabric during the laundering process. Preferably, the black reactive dye (component (a)) is the major component of the reactive dye.

Preferably the black or blue reactive dye of component (b) is a compound having one of the following formulae:

(I-1)

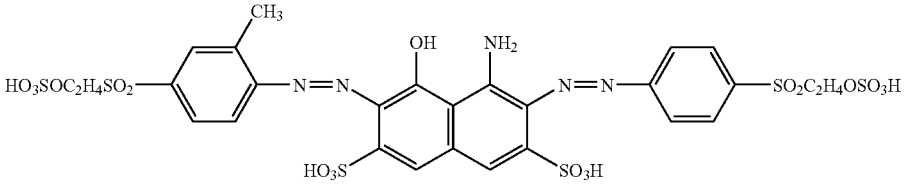

(I-2)

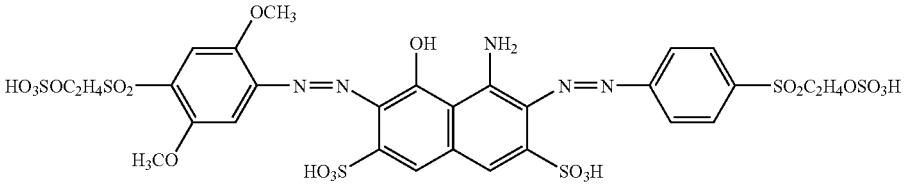

(I-3)

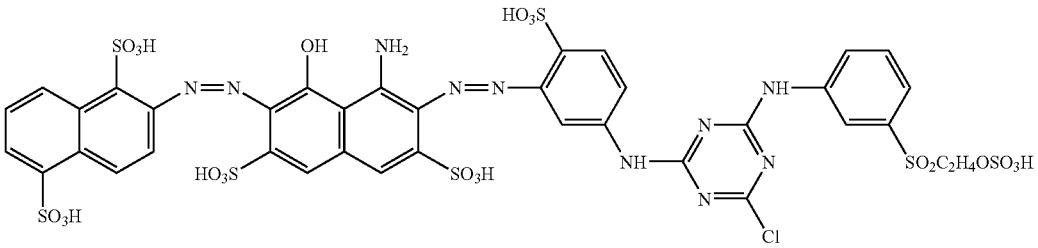

There is no special limitation on the red, orange or yellow reactive azo dye of component (c). Any red, orange and/or yellow reactive azo dyes can be used. More specific examples of component (c) are:

(III-1)

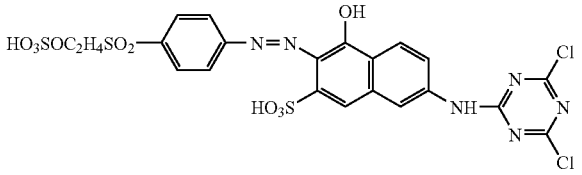

(III-2)

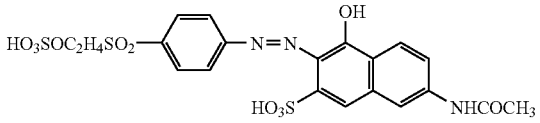

(III-3)

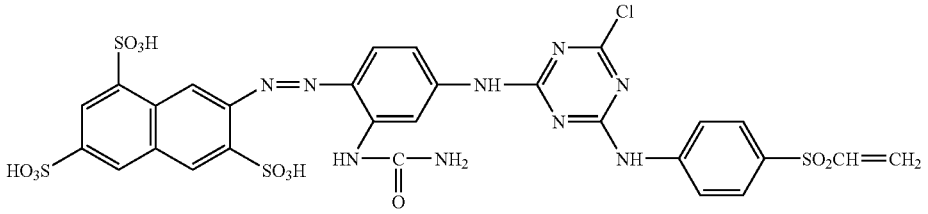

(III-4)

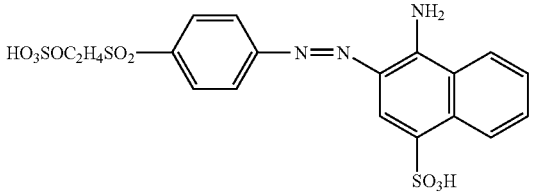

(III-5)

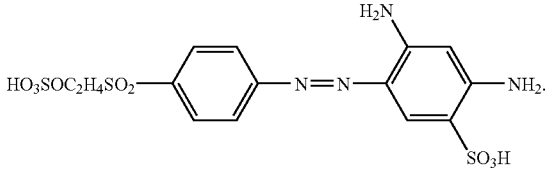

The weight ratio of the dye components (a), (b) and (c) may vary. However, typically, the reactive dye comprises at least 3 wt % component (a), at least 3 wt % component (b) and at least 3 wt % component (c). Preferably, the reactive dye comprises from 3 wt % to 90 wt % component (a). Examples of suitable reactive dyes are described in detail below. Formula is given in parenthesis, the number is the wt % of the component in the reactive dye.

| Example | Component (a) (%) | Component (b) (%) | Component (c) (%) | Component (c) (%) |
|---|---|---|---|---|
| 1 | (II) 58 | (I-1) 20 | (III-2) 15 | (III-3) 7 |
| 2 | (II) 29 | (I-1) 61 | (III-1) 7 | (III-3) 3 |
| 3 | (II) 59 | (I-1) 21 | (III-2) 20 | 0 |
| 4 | (II) 28 | (I-1) 62 | (III-2) 10 | 0 |
| 5 | (II) 55 | (I-1) 16 | (III-4) 17 | (III-5) 12 |
| 6 | (II) 31 | (I-1) 52 | (III-4) 10 | (III-5) 7 |
| 7 | (II) 57 | (I-2) 22 | (III-1) 14 | (III-3) 7 |
| 8 | (II) 27 | (I-2) 63 | (III-1) 7 | (III-3) 3 |
| 9 | (II) 58 | (I-2) 23 | (III-2) 19 | 0 |
| 10 | (II) 27 | (I-2) 64 | (III-2) 9 | 0 |
| 11 | (II) 54 | (I-2) 17 | (III-4) 17 | (III-5) 12 |
| 12 | (II) 29 | (I-2) 55 | (III-4) 9 | (III-5) 7 |
| 13 | (II) 56 | (I-3) 23 | (III-1) 14 | (III-3) 7 |
| 14 | (II) 26 | (I-3) 64 | (III-1) 7 | (III-3) 3 |
| 15 | (II) 57 | (I-3) 24 | (III-2) 19 | 0 |
| 16 | (II) 26 | (I-3) 65 | (III-2) 9 | 0 |
| 17 | (II) 54 | (I-3) 17 | (III-4) 17 | (III-5) 12 |

-continued

| Example | Component (a) (%) | Component (b) (%) | Component (c) (%) | Component (c) (%) |
|---|---|---|---|---|
| 18 | (II) 29 | (I-3) 56 | (III-4) 9 | (III-5) 6 |
| 19 | (II) 89 | (I-1) 11 | 0 | 0 |
| 20 | (II) 42 | (I-1) 58 | 0 | 0 |
| 21 | (II) 81 | (I-2) 19 | 0 | 0 |
| 22 | (II) 40 | (I-2) 60 | 0 | 0 |
| 23 | (II) 80 | (I-3) 20 | 0 | 0 |
| 24 | (II) 39 | (I-3) 61 | 0 | 0 |

pH.

Upon contact with water the composition has an equilibrium pH of 10.5 or greater at a concentration of 4 g/l in de-ionized water and at a temperature of 20° C. Preferably, upon contact with water the composition has an equilibrium pH in the range of from 10.5 to 12.0 at a concentration of 4 g/l in de-ionized water and at a temperature of 20° C. Preferably, upon contact with water the composition has an equilibrium pH of 11.0 or greater at a concentration of 4 g/l in de-ionized water and at a temperature of 20° C.

Without wishing to be bound by theory, it is believed that the high pH improves the strength of the dye-fabric interaction, improves the fabric-substantivity of reactive dye and improves the colour rejuvenation profile of the solid laundry detergent composition.

The method of determining the pH profile of the composition is described in more detail below.

Method for Determining the pH Profile.

Dose 2.00 g of composition into a glass beaker and add 150 ml of de-ionised water at 20° C. Stir using a magnetic stirrer. Transfer the mixture from the beaker into a volumetric flask and make up to 500 ml with de-ionised water at 20° C. Mix well. Calibrate a pH meter using pH 7 and pH 10 buffers. Measure the pH of the solution using the calibrated pH meter.

Alkalinity Source.

The composition preferably comprises a source of alkalinity. Preferably, the alkalinity source is selected from the group consisting of: silicate salt, such as sodium silicate, including sodium meta-silicate; source of carbonate such as sodium carbonate and potassium carbonate; source of hydroxide, such as potassium hydroxide and sodium hydroxide; and mixtures thereof.

Source of Carbonate

Preferably, the composition comprises a source of carbonate. Preferably, the composition comprises a source of carbonate in an amount of 10 wt % or greater. Preferably, the composition comprises from 30 wt % to 70 wt % sodium carbonate.

Enzyme System

Preferably, the composition comprises an enzyme system. Preferably, the enzyme system has protolytic activity, amylolytic activity and cellulolytic activity. Preferably, the composition comprises from 3 to 25 APU activity of protease, from 10 to 50 KNU activity of amylase and from 750 CEVU to 1,500 CEVU activity of cellulase.

Method of Manufacture

The composition of the present invention can be made by any suitable method, such as agglomeration, spray drying, or an extrusion process.

EXAMPLES

Examples 25-27

The following example compositions are solid free flowing granular laundry detergent compositions according to the present invention.

| Ingredient | 25 (wt %) | 26 (wt %) | 27 (wt %) |
|---|---|---|---|
| Sodium carbonate | 66 | 66 | 80 |
| $C_8$-$C_{18}$ alkyl ethoxylated alcohol having an average degree of ethoxylation of 7 | 1.1 | 1.1 | 1 |
| Alkyl polyglucoside | 10 | 10 | 9 |
| Quaternary ammonium cationic detersive surfactant | 1.1 | 1.1 | 1.4 |
| A compound having the following general structure: bis($(C_2H_5O)(C_2H_4O)n$)($CH_3$)—$N^+$—$C_xH_{2x}$—$N^+$—($CH_3$)-bis($(C_2H_5O)(C_2H_4O)n$), wherein n = from 20 to 30, and x = from 3 to 8, or sulphated or sulphonated variants thereof | 1.7 | 1.7 | 1.2 |
| 1-hydroxy ethane-1,1-diphosphonic acid (HEDP) | 0.4 | 0.4 | 0.8 |
| Silicone suds suppressor | 0.08 | 0.08 | 0.08 |
| Protease | 0.2 | | 0.2 |
| Amylase | 0.5 | | 0.3 |
| Mannanase | 0.3 | | 0.3 |
| Cellulase | 0.6 | | 0.3 |
| Reactive dye of examples 1-24 | 1.1 | 1.1 | 0.6 |
| Miscellaneous and moisture | to 100 wt % | to 100 wt % | to 100 wt % |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A solid laundry detergent composition comprising a detersive surfactant and a mixture of reactive azo dyes, wherein:

the reactive dye is in the form of an alkali metal salt;

upon contact with water the composition has an equilibrium pH of 10.5 or greater at a concentration of 4 g/l in de-ionized water and at a temperature of 20° C.;

the solid laundry detergent composition is essentially free of anionic detersive surfactant; and the mixture of reactive azo dyes comprises:

(a) from 3 wt. % to 90 wt. %, based on the total weight of the mixture, of a first reactive azo dye having the formula (II):

(II)

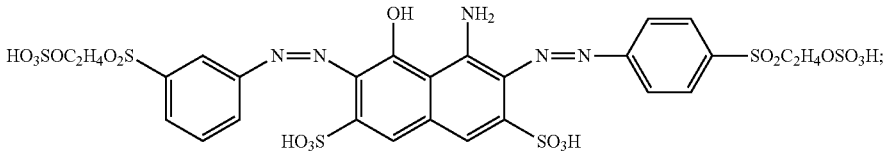

and (b) at least 3 wt. %, based on the total weight of the mixture, of at least one second reactive azo dye selected from black or blue reactive azo dyes according to the general formula (I):

(I)

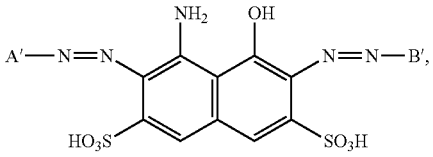

where A' and B' are independently selected from aromatic groups substituted or unsubstituted by halogen, $C_1$-$C_4$ alkyl groups, $C_1$-$C_4$ alkoxyl groups, sulfonyl groups, or amino groups.

2. The composition according to claim 1, wherein the composition comprises an alkalinity source selected from the group consisting of: silicate salt, such as sodium silicate, including sodium meta-silicate; source of carbonate such as sodium carbonate and potassium carbonate; source of hydroxide, such as potassium hydroxide and sodium hydroxide; and mixtures thereof.

3. The composition according to claim 1, wherein the composition comprises from 30 wt % to 70 wt % sodium carbonate, based on the weight of the composition.

4. The composition according to claim 1, wherein the composition comprises a non-ionic detersive surfactant.

5. The composition according to claim 4, wherein the composition comprises a $C_{10}$-$C_{18}$ alkyl alkoxylated alcohol having an average degree of alkoxylation of from 1 to 10.

6. The composition according to claim 4, wherein the composition comprises a predominantly $C_{16}$ alkyl ethoxylated alcohol having an average degree of ethoxylation of from 3 to 7.

7. The composition according to claim 4, wherein the composition comprises an alkyl polyglucoside.

8. The composition according to claim 1, wherein the composition is essentially free of sodium sulphate.

9. The composition according to claim 1, wherein the composition is essentially free of bleach.

10. The composition according to claim 1, wherein the composition is essentially free of phosphate builder.

11. The composition according to claim 1, wherein the composition is essentially free of zeolite builder.

12. The composition according to claim 1, wherein the composition is essentially free of sodium silicate.

13. The composition according to claim 1, wherein the composition comprises an enzyme system having protolytic activity, amylolytic activity and cellulolytic activity.

14. The composition according to claim 1, wherein, the composition comprises from 3 to 25 APU activity of protease, from 10 to 50 KNU activity of amylase and from 750 CEVU to 1,500 CEVU activity of cellulase.

15. The composition according to claim 1, wherein the detersive surfactant is a non-ionic detersive surfacatant comprising an alkyl polyglucoside and a $C_{10}$-$C_{18}$ alkyl alkoxylated alcohol having an average degree of alkoxylation of from 1 to 10.

16. The composition according to claim 1, wherein the solid laundry detergent composition is essentially free of anionic detersive surfactant and sodium sulfate.

17. A solid laundry detergent composition comprising:

(a) a non-ionic detersive surfactant comprising an alkyl polyglucoside and a $C_{10}$-$C_{18}$ alkyl alkoxylated alcohol having an average degree of alkoxylation of from 1 to 10; and (b) a mixture of reactive azo dyes, the mixture comprising:

(i) 3 wt. % to 90 wt. %, based on the total weight of the mixture, of a first reactive azo dye having the formula (II):

(II)

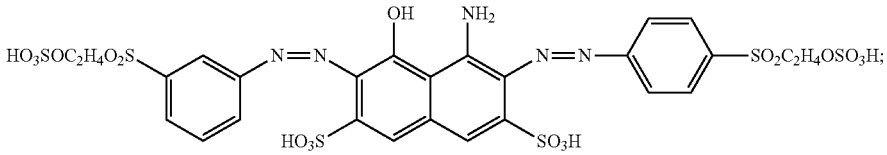

and (ii) at least 3 wt. %, based on the total weight of the mixture, of at least one second reactive azo dye selected from black or blue reactive azo dyes according to the general formula (I):

(I)

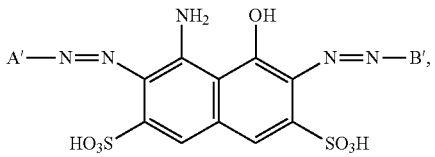

wherein A' and B' are independently selected from aromatic groups substituted or unsubstituted by halogen, $C_1$-$C_4$ alkyl groups, $C_1$-$C_4$ alkoxyl groups, sulfonyl groups, or amino groups.

* * * * *